US007402081B2

(12) United States Patent
Si et al.

(10) Patent No.: US 7,402,081 B2
(45) Date of Patent: Jul. 22, 2008

(54) ELECTRICAL CONNECTOR WITH IMPROVED METALLIC SHELL

(75) Inventors: Dong-Dong Si, Kunshan (CN); Chi Zhang, Kunshan (CN); Guo-Jian Shen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/807,557

(22) Filed: May 29, 2007

(65) Prior Publication Data

US 2007/0275579 A1 Nov. 29, 2007

(30) Foreign Application Priority Data

May 29, 2006 (CN) ..... 2006 0 073306

(51) Int. Cl.
*H01R 13/648* (2006.01)

(52) U.S. Cl. ..... 439/607; 439/108

(58) Field of Classification Search ..... 439/79, 439/101, 108, 607, 637
See application file for complete search history.

(56) References Cited

U.S. PATENT DOCUMENTS 6,247,967 B1 * 6/2001 Wu et al. ..... 439/607
6,811,439 B1 * 11/2004 Shin-Ting ..... 439/607
6,890,193 B2 * 5/2005 Kimura et al. ..... 439/108
6,913,488 B2 7/2005 Motojima et al.
7,018,238 B1 * 3/2006 Zhi-xuan ..... 439/607
7,189,116 B2 * 3/2007 Wei ..... 439/607
7,281,943 B1 * 10/2007 Yamaji et al. ..... 439/495

* cited by examiner

*Primary Examiner*—Thanh-Tam T Le
(74) *Attorney, Agent, or Firm*—Wei Te Chung

(57) ABSTRACT

An electrical connector (100) an insulated housing (10) having a rectangular base (110) and a top wall (120) extending forward from the base, the top wall having a plurality of receiving grooves (121) at its inner surface, a plurality of partition walls (122) each between every two receiving grooves, and a guiding channel (123) recessed downward from its outer surface to be corresponding to the partition wall; a plurality of contacts (30) retained in the corresponding receiving grooves; a metallic shell (20) assembled to surround the insulated housing and having a plate (210) for shielding the wall of the housing, the plate having a bend portion (211) extending from a middle portion of a rear edge thereof and guided by the guiding channel to be retained in the base.

11 Claims, 8 Drawing Sheets

ELECTRICAL CONNECTOR WITH IMPROVED METALLIC SHELL

BACKGROUND OF THE INVENTION

1. Field of the Invention

The present invention generally relates to an electrical connector, and more particularly to a connector for connecting a printed circuit board (PCB) to a flexible circuit board (FPC) or a flexible flat cable (FFC).

2. Description of Related Art

Electrical connectors are widely used for signal or power transmission between electronic elements. Due to continuing trend toward miniaturization and portability by the electronics industry, requirements for simpler configurations and lower profiles of connectors are constantly being promulgated. A conventional electrical connector is disclosed in U.S. Pat. No. 6,913,488. The electrical connector defines a mating cavity for receiving a complementary connector and comprising an insulated housing having a base extending along a longitudinal direction and a top wall integrally extending from an upper portion of a front surface of the base, a plurality of contacts retained in the base, a metallic shell surrounding around the outer of housing. The top wall acts as one wall of the mating cavity, and a first shielding plate of the metallic shell acts as the other wall of the mating cavity so that make the electrical connector in a lower profile.

The metallic shell further has a second shielding plate opposite to the first shielding plate for shielding the top wall of the housing. However, the second shielding member shaped in substantially rectangular has no engaging portions for being latched onto the housing except for a pair of solder legs extending from its lateral sides for connecting on a PCB, as a result, the second shielding member is prone to distort away from the top wall. In order to solve the problem of the above connector, generally, the second shielding member is constructed by having engaging portions. Accordingly, for reliably retaining the engaging portions, the height of the housing must be increased to have preferable engagement therebetween, which result in increasing the connector's entire height and deviating from the trend of miniaturization.

Hence, an improved electrical connector is highly desired.

SUMMARY OF THE INVENTION

Accordingly, an object of the present invention is to provide an electrical connector which is hardly distorted.

Another object of the present invention is to provide an electrical connector with a lower profile.

In order to achieve the object set forth, an electrical connector in accordance with the present invention comprises an insulated housing having a rectangular base and a wall extending forward from the base, the wall having a plurality of receiving grooves at its inner surface, a plurality of partition walls each between every two receiving grooves, and a guiding channel recessed downward from its outer surface to be corresponding to the partition wall; a plurality of contacts retained in the corresponding receiving grooves; a metallic shell assembled to surround the insulated housing and having a plate for shielding the wall of the housing, the plate having a bend portion extending from a middle portion of a rear edge thereof and guided by the guiding channel to be retained in the base.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
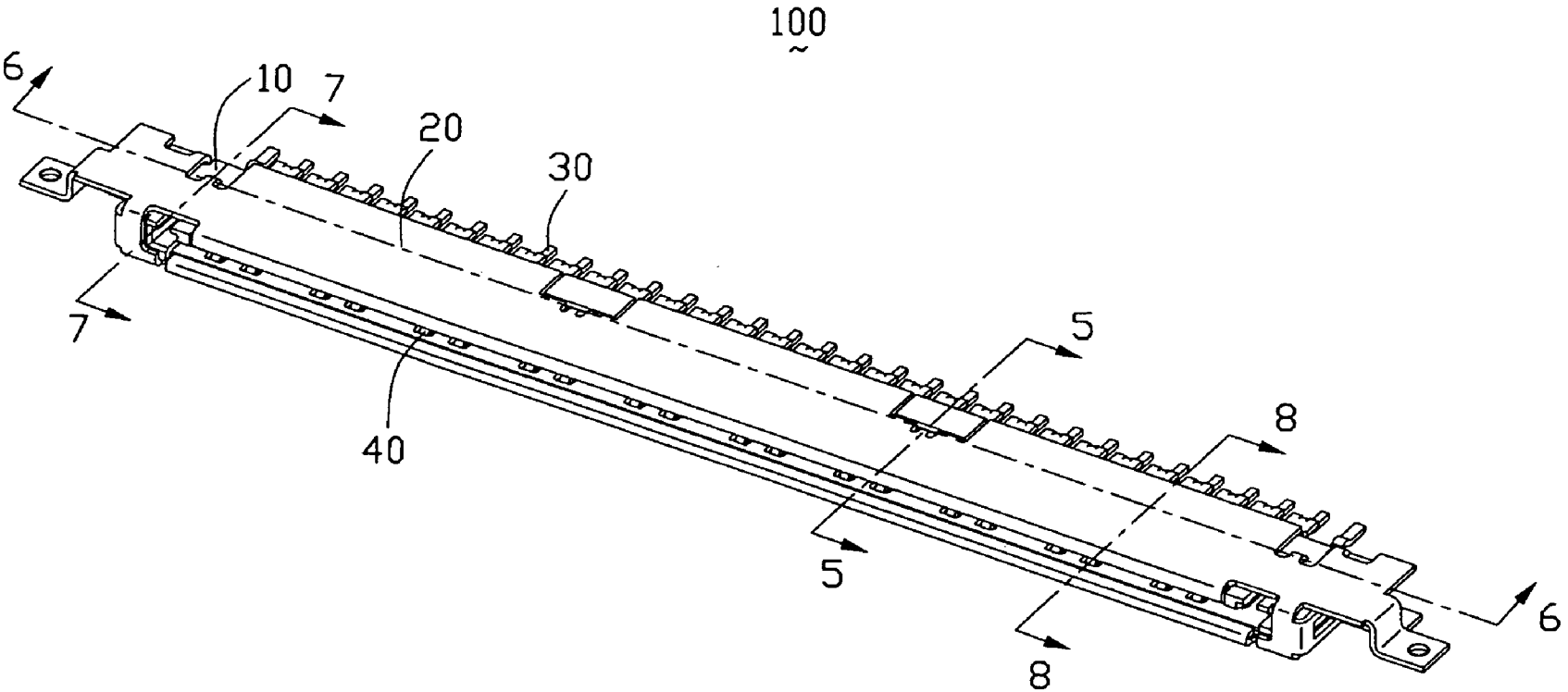
FIG. 1 is an assembled, perspective view of an electrical connector in accordance with the present invention.
Figure 2:
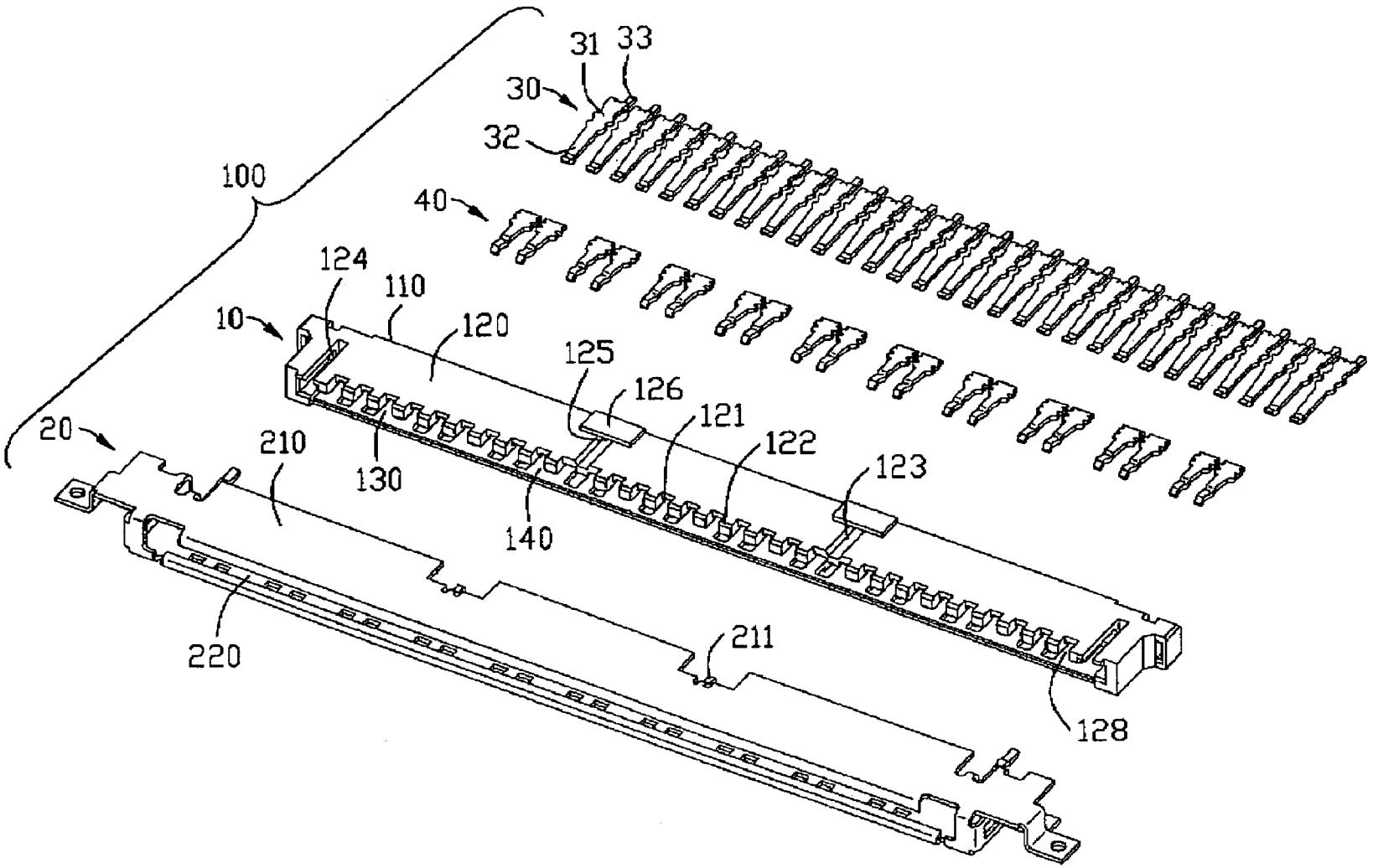
FIG. 2 is an exploded, perspective view of the electrical connector shown in FIG. 1.

Referring to FIGS. 1 and 2, an electrical connector 100 in accordance with the present invention comprises an insulated housing 10, a metallic shell 20 arranged to surround the housing 10, a plurality of first contacts 30 and second contacts 40 which are retained in the housing 10. In this embodiment, the first contacts 30 used for transmitting signals are defined as signal contacts, and the second contacts 40 used for grounding are defined as grounding contacts.

Figure 4:
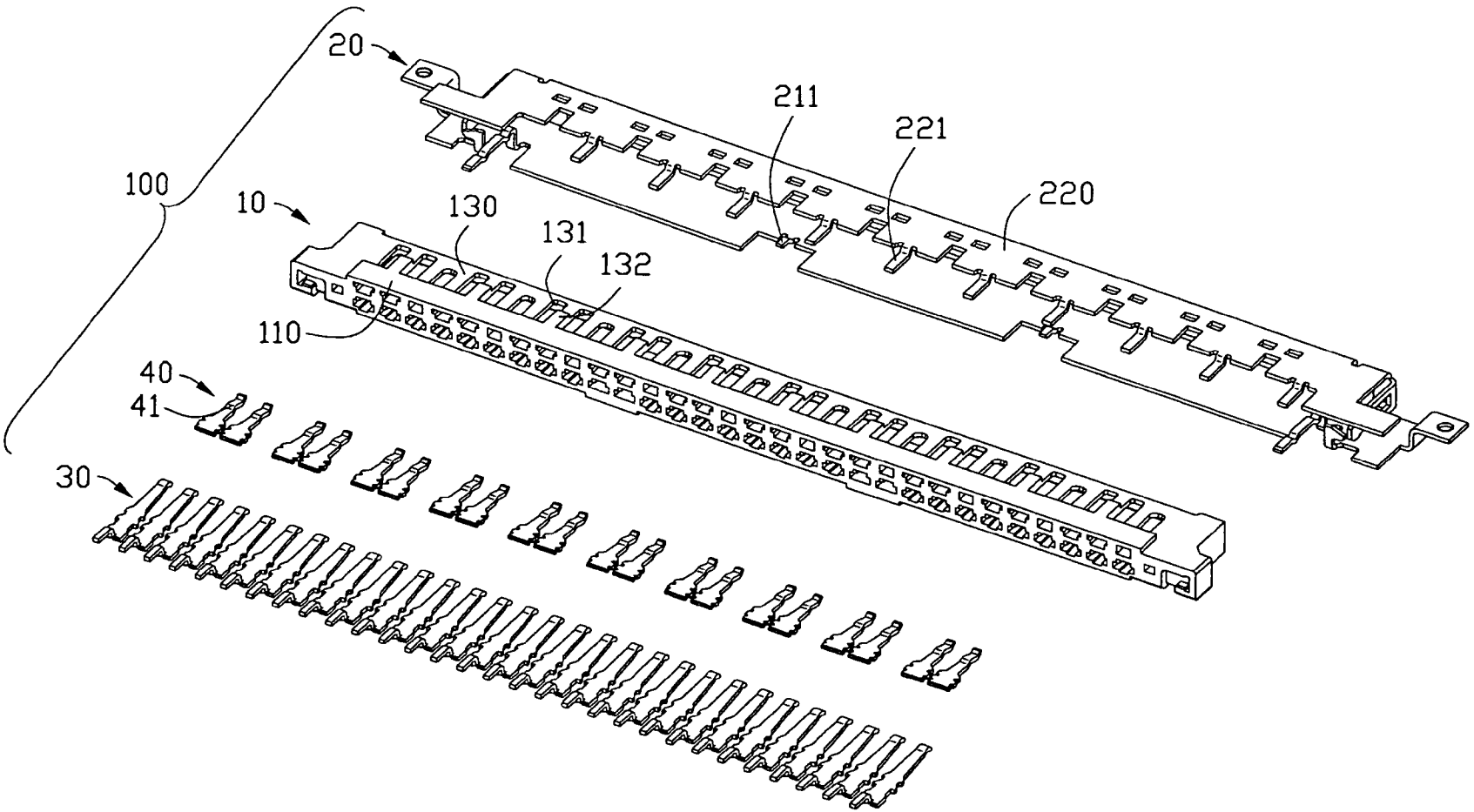
FIG. 4 is an exploded, perspective view of the electrical connector shown in FIG. 3.

Referring to FIGS. 2 and 4, the insulated housing 10 is substantially elongated and comprises a base 110 extending along a longitudinal direction and a mating portion extending forward from a front surface of the base 110 along a front-to-back direction perpendicular to the longitudinal direction. The mating portion has a mating cavity 140 surrounded by a top wall 120, a bottom wall 130 spaced opposite to the top wall 120 and a pair of transverse walls connecting the top and bottom wall 120, 130 together for accommodating a complementary connector (not shown).

The top wall 120 has a plurality of receiving grooves 121 in communication with the mating cavity 140 at its inner surface for retaining the first contacts 30, a pair of guiding channels 123 with a reversed trapeziform cross section recessed downward from a middle portion of its upper surface and extending from a front edge of the top wall 120 to the base 110, and a pair of slots 124 respectively located at lengthwise ends thereof and extending through the top wall 120 to be in communication with the mating cavity 140. A plurality of partition walls 122 are respectively formed between every two receiving grooves 121, and said guiding channels 123 are corresponding to the partition wall 122 in a thickness direction of the housing 10 perpendicular to the longitudinal direction and the front-to-back direction. The upper surface of the top wall 120 is substantially coplanar with that of the base 110. The bottom wall 130 has a plurality of short and long receiving channels 131 extending therethrough in a vertical direction perpendicular to the longitudinal direction and the front-to-back direction and arranged in a one-two style along the longitudinal direction, and a plurality of rib portions 132 formed between every two adjacent long channels 131 to reinforce the intensity of bottom wall 130. Each rib portion 132 has a bottom surface coplanar with that of the base 110. The base 110 has a pair of concaves 125 recessed downward from its upper surface to be corresponding to and in communication with the guiding channels 123, a pair of projections 126 extending over the corresponding concaves 125 and a pair of passageways 111 respectively in communication with the slots 124 and the mating cavity 140.

Figure 3:
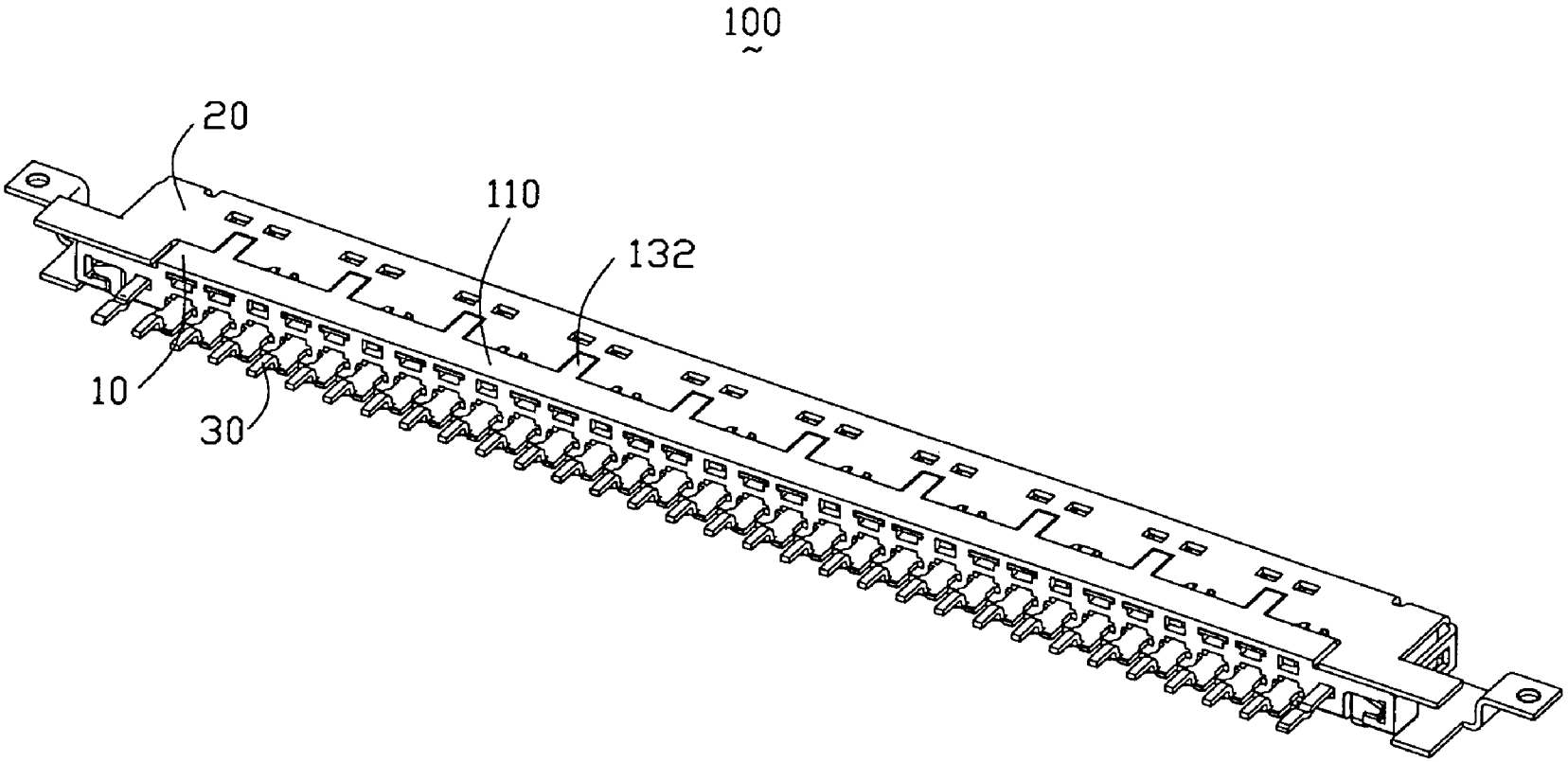
FIG. 3 is a similar view of FIG. 1, but taken from another aspect.

Referring to FIGS. 3 and 4, each first contact 30 comprises a retention portion 31 retained in the base 110, a contact beam 32 extending forward from the retention portion 31 with a contact portion at its front end exposed to the mating cavity 140 and a solder portion 33 extending rearward from the retention portion 31 to electrically connect to a printed circuit board. All the first contacts 30 are retained in the receiving grooves 121 defined on the top wall 120. For having enough space for receiving the contact portions of the first contacts 30, the top wall 120 defines a plurality of cutouts 128 extending through its front end and corresponding to the contact portions, as FIG. 2 shown, thus the front faces of the receiving groove is behind corresponding front faces of the partition walls. The second contacts 40 are received in said long channels 131 and retained by the base 110. Each second 40 has a resilient beam 41 extending along the corresponding long channels 131. The resilient beam 41 has a first contact portion 410 curving toward the mating cavity 140 and a second contact portion 420 spaced rearward from the first contact portion 410 in the front-to-back direction and curing opposite to the first contact portion 410 for electrically contacting with the metallic shell 20 to form a grounding path thereby.

Referring to FIGS. 2 and 4, the metallic shell 20 has a first plate 210 for shielding the top wall 120 and a second plate 220 for shielding the bottom wall 130. For the metallic shell 20 can be firmly retained in the housing 10, the first plate 210 has a pair of bend portions 211 extending its rear end to be retained in the corresponding concaves 125 and a pair of securing portions extending rearward from its lengthwise ends, and the second plate 220 defines a plurality of opening for engaging with the corresponding rib portions 132 (shown in FIG. 3) and further defines a plurality of retaining tangs 221 extending into the corresponding receiving slits 133 in the housing 10 wherein the receiving slits are intermingled with the channels 131 along the longitudinal direction.

Figure 5:
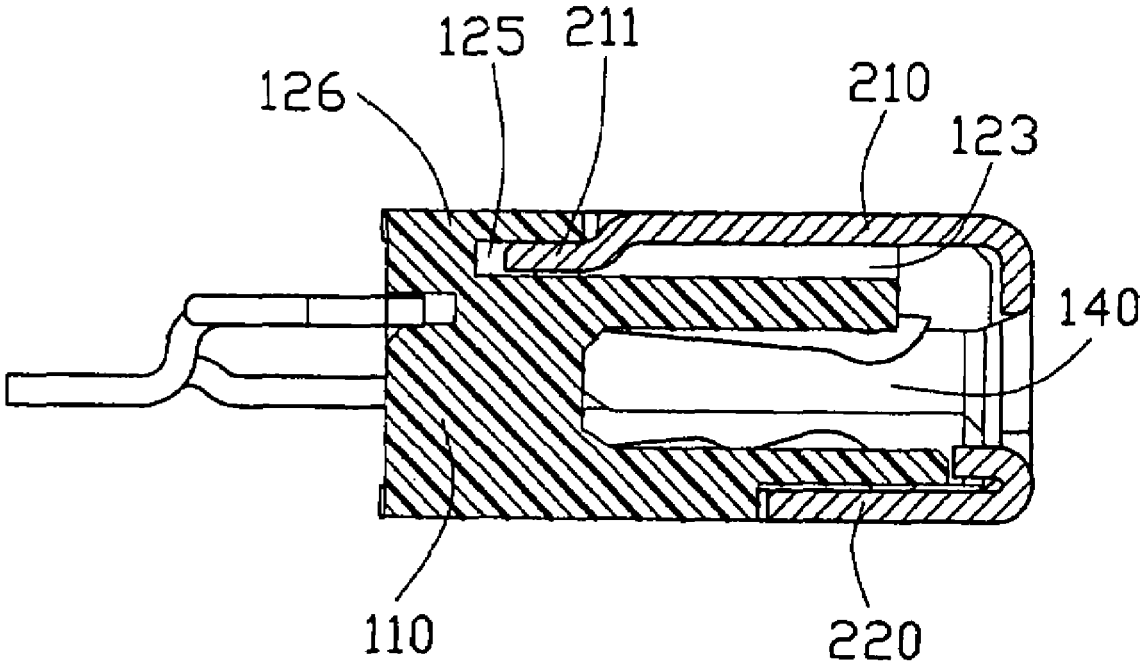
FIG. 5 is a cross-sectional view of FIG. 1, taken along line 5-5.
Figure 6:
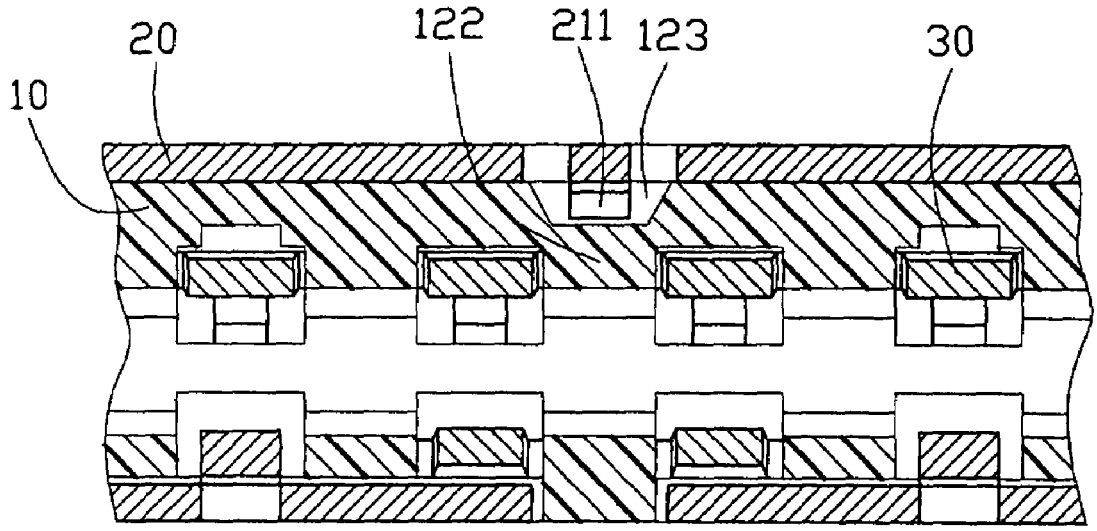
FIG. 6 is a cross-sectional view of FIG. 1, taken along line 6-6.

Further referring to FIGS. 5 and 6, it is noted that the guiding channels 123 are recessed from the upper surface of the top wall 120 with a reversed trapeziform cross section and corresponding to the partition walls 122 between the receiving grooves 121, which not only make the electrical connector in a lower profile, but also render enough intensity to the top wall 120. When assembling, the bend portions 211 are preferably guided by the guiding channels 123 to be inserted into the concaves 125, and finally firmly restricted by the canvases 125 and the projections 126 in said thickness direction, and thus the first plate 210 are hardly distorted.

Figure 7:
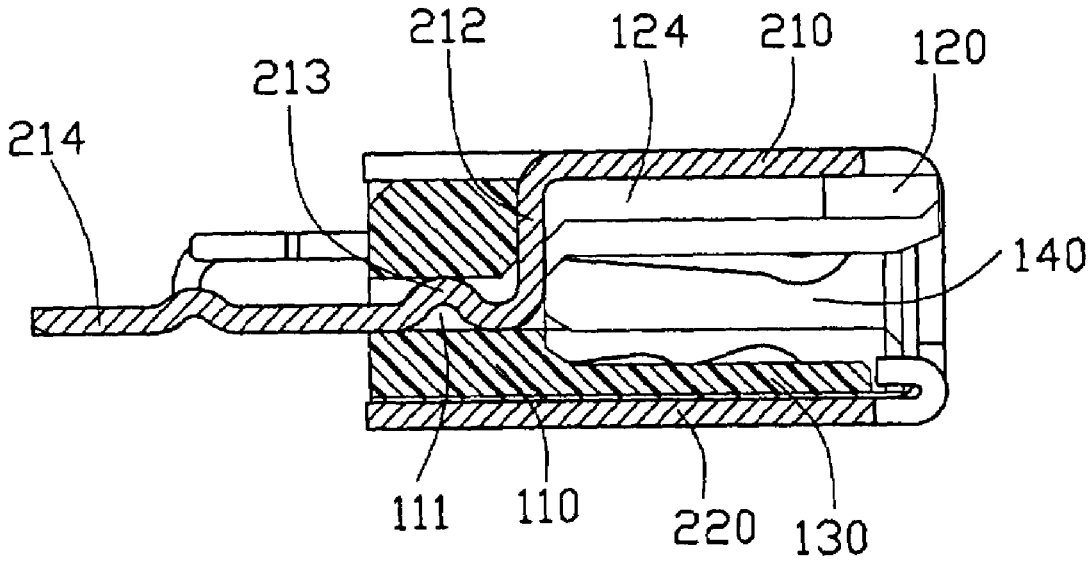
FIG. 7 is a cross-sectional view of FIG. 1, taken along line 7-7.
Figure 8:
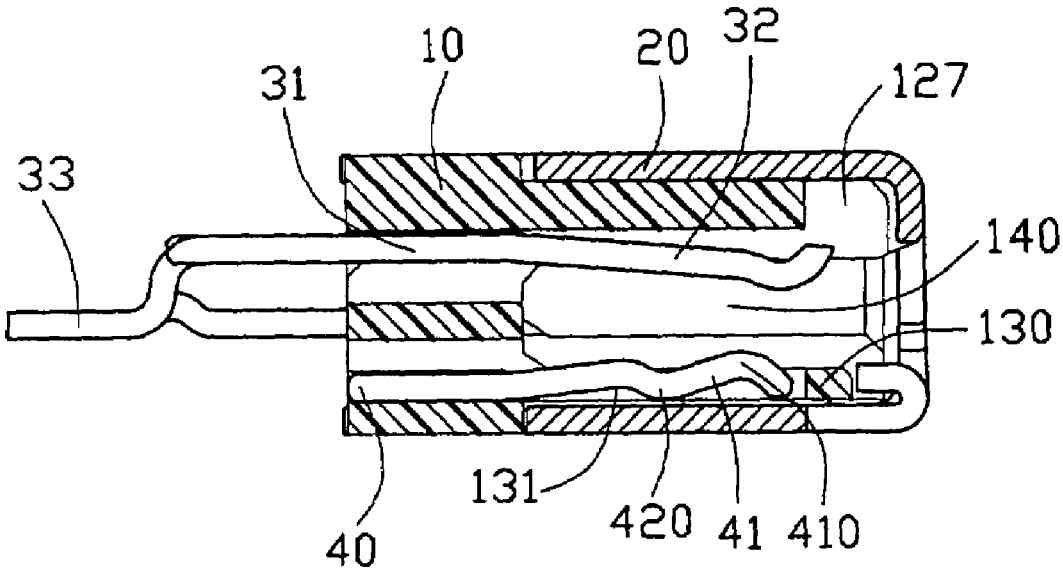
FIG. 8 is a cross-sectional view of FIG. 1, taken along line 8-8.

Referring to FIGS. 4 and 7, the securing portions are retained in lengthwise ends of the housing 10. Each securing portion has a connecting portion 212 projecting downward from the rear edge of the first plate 210, and through the corresponding slots 124; a retaining portion 213 extending rearward from the connecting portion 212 and forming curved portions for firmly engaging with passageway 111 of the base 110; and a solder legs 214 extending from the retaining portion 213 for connecting onto the printed circuit board. Specially, the connecting portions 212, the retaining portions 213 and the solder legs 214 are constructed before assembling so as to not only achieve a preferable coplanarity of the solder legs 214 but also simplify manufacturing process, and reduce the product cost accordingly.

It is to be understood, however, the disclosure is illustrative only, and changes may be made in detail, especially in matters of shape, size, and arrangement of parts within the principles of the invention. For example, the guiding channels 123 can extend into the partition walls 122 to further make the electrical connector in a lower profile.

What is claimed is:

1. An electrical connector comprising:

an insulative housing having a rectangular base, top and bottom longitudinal walls extending forward from the base and a central receiving slot, the top wall having a plurality of receiving grooves at an inner surface thereof, a plurality of partition walls each located between every two receiving grooves, and a guiding channel recessed from an outer surface to be corresponding to the partition wall;

a plurality of contacts retained in the corresponding receiving grooves;

at least one passageway extending through the base in a mating direction;

a pair of slots respectively located at lengthwise ends of the housing and extending through the top wall thereof in communication with the central receiving slot and communicatively aligned with the passageway; and a metallic shell being in a hollow rectangle having a top plate for shielding the top wall of the housing and a bottom plate for shielding the bottom wall of the housing, a pair of securing portions retained in the lengthwise ends of the housing;

wherein front faces of the receiving grooves are behind corresponding front faces of the partition walls;

wherein the top plate having a bend portion extending from a middle portion thereof and guided by the guiding channel to be retained in the base; and wherein each securing portion includes:

a connection portion unitarily projecting downward from a rear edge of the top plate, through the corresponding slot and abutting against a front face of the housing in the mating direction, a retaining portion extending rearward from the connection portion and forming a curved portion for firmly engaging with the at least one passageway with regard to the housing without relative movement, wherein the retaining portion is fully surrounded by said passageway only, and a solder tail extending from the retaining portion and extending out of a rear face of the housing.

2. The electrical connector as claimed in claim 1, wherein the base has a concave in communication with the guiding channel for receiving the bend portion and a projection extending over the concave for cooperating with the concave to confine the movement of the metallic shell.

3. The electrical connector as claimed in claim 2, wherein the guiding channel extends from a front edge of the partition wall toward the base.

4. The electrical connector as claimed in claim 1, wherein the guiding channel has reversed trapeziform cross section.

5. An electrical connector comprising:

an insulative housing defining a central receiving slot through a front face and extending along a longitudinal direction thereof with top and bottom longitudinal walls by two sides of the central receiving slot;

two rows of contact receiving passages formed in the housing and located by the two sides of the central receiving slot and at least partially enclosed by the corresponding longitudinal wall, respectively;

at least one passageway extending through a base of the housing in a mating direction which is perpendicular to the longitudinal direction;

two rows of discrete and independent contacts disposed in the two rows of contact receiving passages, respectively;

a pair of slots respectively located at lengthwise ends of the housing and extending through the top wall of the housing in communication with the central receiving slot and communicatively aligned with the passageway; and a metallic shell being in a hollow rectangle having a top plate for shielding the top wall of the housing and a bottom plate for shielding the bottom wall of the housing, a pair of securing portions retained in the lengthwise ends of the housing;

wherein each securing portion includes:

a connection portion unitarily projecting downward from a rear edge of the top plate, through the corresponding slot and abutting against the front face of the housing in the mating direction, a retaining portion extending rearward from the connection portion and forming a curved portion for firmly engaging with the at least one passageway with regard to the housing without relative movement, wherein the retaining portion is fully surrounded by said passageway only, and a solder tail extending from the retaining portion and extending out of a rear face of the housing.

6. The electrical connector as claimed in claim 5, wherein said solder tail is coplanar with other solder tails of one of said two rows of contacts.

7. The electrical connector as claimed in claim 6, wherein said one row of the contacts do not contact the shell while the other row of the contacts mechanically and electrically engaged with the shell.

8. An electrical connector comprising:

an insulative housing defining a central receiving slot through a front face and extending along a longitudinal direction thereof with top and bottom longitudinal walls by two sides of the central receiving slot;

two rows of contact receiving passages formed in said housing and located by the two sides of the central slot and at least partially enclosed by the corresponding longitudinal wall, respectively;

two rows of discrete and independent contacts disposed in said two rows of the contact receiving passages, respectively;

at least one passageway extending through a base of the housing in a mating direction;

a pair of slots respectively located at lengthwise ends of the housing and extending through the top wall thereof in communication with the central receiving slot and communicatively aligned with the passageway; and a metallic shell having a top plate for shielding the top wall of the housing and a bottom plate for shielding the bottom wall of the housing, a pair of securing portions retaining in the lengthwise ends of the housing;

wherein the metallic shell being in a hollow rectangle configuration enclosing said housing under a condition that one of the two rows of contacts are electrically and mechanically engaged with the shell while the other not;

wherein the housing further defines therein a plurality of receiving channels in one of the longitudinal walls intermingled with said one of the two rows of contact receiving passages along the longitudinal direction, and the shell further defines a plurality of retaining tangs rearwardly extending into the corresponding receiving channels, respectively; and wherein each securing portion includes:

a connection portion unitarily projecting downward from a rear edge of the top plate, through the corresponding slot and abutting against the front face of the housing in the mating direction, a retaining portion extending rearward from the connection portion and forming a curved portion for firmly engaging with the at least one passageway with regard to the housing without relative movement, wherein the retaining portion is fully surrounded by the passageway only, and a solder tail extending from the retaining portion and extending out of a rear face of the housing.

9. The electrical connector as claimed in claim 8, wherein said receiving channels extend through the rear face of the housing while not through the front face.

10. The electrical connector as claimed in claim 8, wherein said receiving channels are extending through one side wall in a vertical direction perpendicular to the longitudinal direction and the mating direction.

11. The electrical connector as claimed in claim 10, wherein said receiving channels have different lengths in the mating direction and are arranged in one short and two long style.

* * * * *